US011207580B1

(12) United States Patent
Mynatt

(10) Patent No.: US 11,207,580 B1
(45) Date of Patent: Dec. 28, 2021

(54) XUBALL GAME

(71) Applicant: Richard Joseph Mynatt, Crossville, TN (US)

(72) Inventor: Richard Joseph Mynatt, Crossville, TN (US)

( * ) Notice: Subject to any disclaimer, the term of this patent is extended or adjusted under 35 U.S.C. 154(b) by 0 days.

(21) Appl. No.: 16/936,879

(22) Filed: Jul. 23, 2020

(51) Int. Cl.

| | |
|---|---|
| ***A63B 67/00*** | (2006.01) |
| ***A63B 63/00*** | (2006.01) |
| *A63B 71/02* | (2006.01) |
| *A63B 63/08* | (2006.01) |

(52) U.S. Cl.
CPC ..... *A63B 67/002* (2013.01); *A63B 63/00* (2013.01); *A63B 63/083* (2013.01); *A63B 71/022* (2013.01); *A63B 2209/00* (2013.01)

(58) Field of Classification Search
CPC ..... A63B 63/007; A63B 63/08–083; A63B 67/002
See application file for complete search history.

(56) References Cited

U.S. PATENT DOCUMENTS

| | | | | |
|---|---|---|---|---|
| 2,130,820 | A | 9/1938 | Trumbull | |
| 3,602,504 | A * | 8/1971 | Chapman | A63B 61/003 473/416 |
| 4,266,764 | A | 5/1981 | Collins | |
| 5,330,175 | A | 7/1994 | Kim | |
| 5,390,913 | A | 2/1995 | Kepler | |
| 5,833,557 | A * | 11/1998 | Cole | A63B 67/002 473/472 |
| 6,299,556 | B1 | 10/2001 | Redden | |
| 6,299,570 | B1 | 10/2001 | Lim | |
| 6,746,348 | B2 * | 6/2004 | Barnes | A63B 63/083 473/431 |
| 9,533,210 | B2 | 1/2017 | Lee | |
| 10,569,160 | B1 | 2/2020 | Peel | |
| 10,646,762 | B2 * | 5/2020 | Bowers | A63B 63/00 |
| 2005/0192126 | A1 | 9/2005 | Remaklus | |
| 2006/0097454 | A1 * | 5/2006 | Mattson | A63B 67/06 273/336 |
| 2009/0149282 | A1 | 6/2009 | Dahlin | |
| 2014/0274489 | A1 * | 9/2014 | Kurt | A63B 63/083 473/472 |
| 2019/0070473 | A1 | 3/2019 | Esch | |
| 2019/0118055 | A1 | 4/2019 | Greiner et al. | |

FOREIGN PATENT DOCUMENTS

| | | | | |
|---|---|---|---|---|
| FR | 2715076 A1 * | 7/1995 | | A63B 63/083 |
| IL | 59309 A | 2/1983 | | |
| RU | 2722713 C1 | 6/2020 | | |
| WO | 9819756 A1 | 5/1998 | | |
| WO | 0166200 A1 | 9/2001 | | |

OTHER PUBLICATIONS

English Abstract of FR 2,715,076 A1 (Year: 1995).*

* cited by examiner

*Primary Examiner* — Laura Davison
(74) *Attorney, Agent, or Firm* — Luedeka Neely Group, PC

(57) ABSTRACT

A ball game and method of playing a ball game. The ball game includes a spherical, air-filled ball, a first backboard mounted on a first support pole at a predetermined height above a first end of a playing court, the first backboard comprising a pair or first hoops mounted on the first backboard, the pair of first hoops being set apart a predetermined distance from one another, and being angled with respect to a horizontal plane defined by the playing court. The pair of first hoops have a diameter that is larger than the diameter of the spherical, air-filled ball.

15 Claims, 4 Drawing Sheets

XUBALL GAME

TECHNICAL FIELD

The disclosure is directed to a game an in particular to a ball game that includes goals and backboards.

BACKGROUND AND SUMMARY

Ball games, such as basketball, ringball, korfball, netball, and slamball, all require a certain level of skill and agility to play and provide an interesting spectator sport. The skill require to compete in some of these games may make it difficult for everyone to participate. Accordingly, what is needed is a ball game that can be played by a wider variety of persons who may not be skilled enough to compete with others when playing conventional ball games such as basketball.

In view of the foregoing, embodiments of the disclosure provide a ball game and method of playing a ball game. The ball game includes a spherical, air-filled ball, a first backboard mounted on a first support pole at a predetermined height above a first end of a playing court, the first backboard comprising a pair or first hoops mounted on the first backboard, the pair of first hoops being set apart a predetermined distance from one another, and being angled with respect to a horizontal plane defined by the playing court. The pair of first hoops have a diameter that is larger than the diameter of the spherical, air-filled ball.

In some embodiments, the ball game includes a second backboard mounted on a second support pole at the predetermined height above a second end of the playing court, the second backboard comprising a pair of second hoops mounted on the second backboard, the pair of second hoops being set apart a predetermined distance from one another, and being angled with respect to a horizontal plane defined by the playing court, wherein the pair of second hoops have a diameter that is larger than the diameter of the spherical, air-filled ball.

In some embodiments, the pair of first hoops and the pair of second hoops further comprise a plurality of brushes disposed around an inside circumference of the pair of first and second hoops.

In some embodiments, the playing court is a rectangular playing court defined by out-of-bounds lines disposed around the perimeter of the playing court.

In some embodiments, the playing court is half the size of a basketball court or a tennis court.

In some embodiments at least one net is disposed above the pair of first and above the pair of second hoops on the first and second backboard to prevent the ball from leaving the playing court when the ball is shot upward through the pair of first and second hoops.

In some embodiments, the pair of first hoops and the pair of second hoops are attached to a middle portion of the first backboard with respect to a vertical dimension of the first backboard.

In some embodiments, the playing court is devoid of a midcourt line.

In another embodiment, there is provided a method of playing a ball game. The method includes providing a spherical, air-filled ball, at least one backboard mounted on a support pole at a predetermined height above a first end of a playing court, the at least one backboard comprising a pair of hoops mounted on the at least one backboard, the pair of hoops being set apart a predetermined distance from one another, and being angled with respect to a horizontal plane defined by the playing court. The pair of hoops have a diameter that is larger than the diameter of the spherical, air-filled ball. The air-filled ball is shot through the pair of hoops so that the ball travels through at least one of the pair of hoops from a top-side of one of the pair of hoops or from a bottom side of one of the pair of hoops. A point is scored for a first team when the ball travels through at least one of the pair of hoops.

In some embodiments, a point is subtracted from the first team if a second team scores a point by causing the ball to travel through at least one of the pair of hoops.

In some embodiments, one point is scored for the first team when a second team commits five fouls on the first team.

In some embodiments two points are scored for the first team when a second team commits ten fouls on the first team.

In some embodiments, the game is timed and a winner of the game is awarded to a team with the most points at an end of a predetermined time.

In some embodiments, the ball game is devoid of foul shots.

DETAILED DESCRIPTION OF THE EMBODIMENTS

Figure 1:
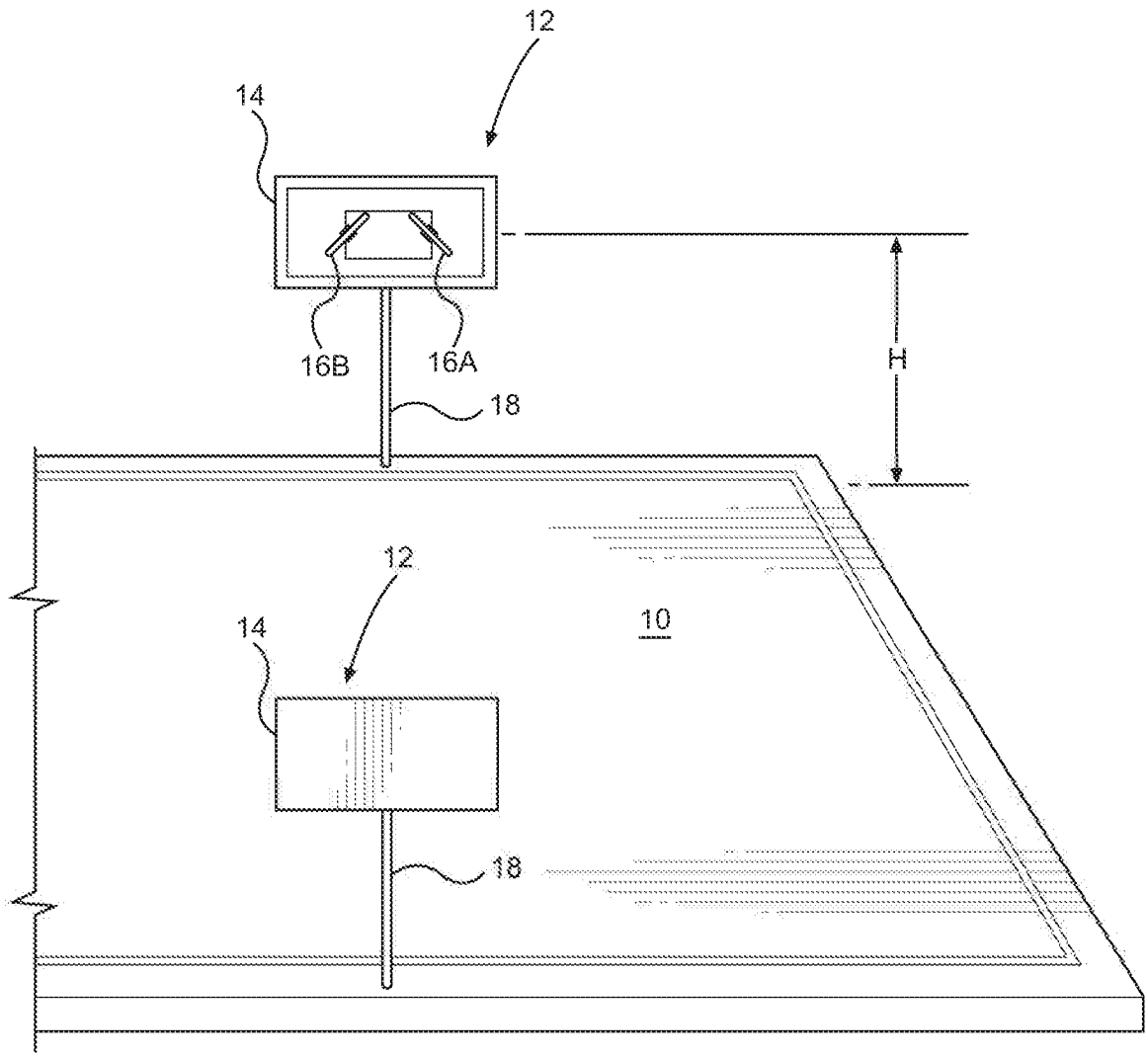
FIG. 1 is a perspective view, not to scale, of a court and goals for playing a ball game according to the disclosure.

With reference to FIG. 1, there is illustrated a playing court 10 and goals 12 for playing a ball game according to the disclosure. The playing court 10 may use half of a regulation basketball court, up to the half-court line, half of a tennis court, up to the net in the middle of a tennis court, or any other hard surface court that is available. The playing court 10 for the ball game includes permanent or portable goals 12 that may be placed along edges of the playing court 10. Each goal 12 includes a backboard 14, a pair of hoops 16A and 16B and a support pole 18.

In some embodiments, a center of the hoops 16A and 16B are above a level of the playing court 10 a height (H) of about nine feet rather than the regulation height of the baskets on a basketball court of 10 feet. Unlike baskets used for basketball games, the hoops 16A and 16B are positioned in a central portion CL of the backboard 14 rather than toward a lower edge 20 of the backboard 14 as shown in FIG. 2.

A unique feature with regard to the ball game according to the disclosure is that the hoops 16A and 16B are set apart a spacing S of about 2 feet and the hoops 16A and 16B are attached to the backboard 14 at an angle ranging from about 40 to about 50 degrees relative to a horizontal plane defined by the playing court 10. In one embodiment, the hoops 16A and 16B are attached to the backboard 14 at an angle of 45 degrees. In some embodiments, the backboard 14 has a length L ranging from about 80 inches to about 84 inches and a height h ranging from about 48 inches to about 52 inches.

Figure 3:
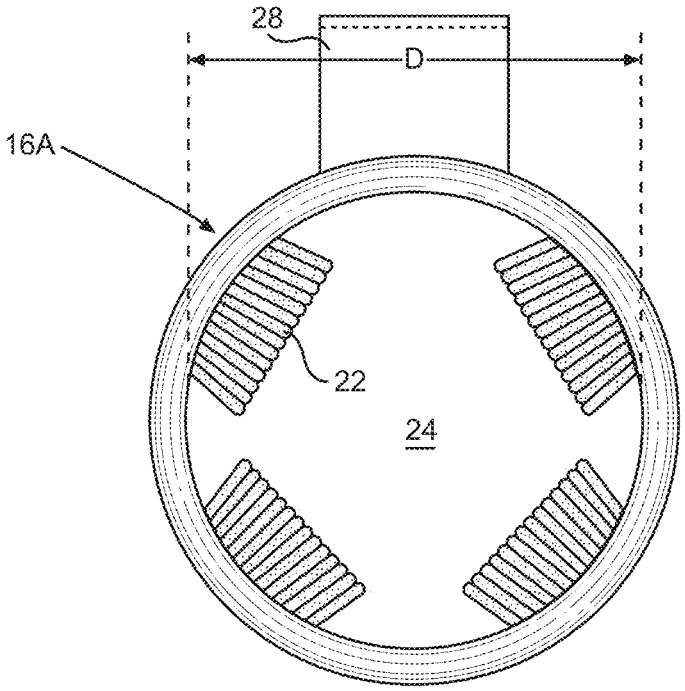
FIG. 3 is a plan, not to scale, of a hoop for providing the goals of FIG. 2.

Another unique feature of the hoops 16A and 16B according to the disclosure is that each hoop, such as hoop 16A shown in FIG. 3, may contain short nets or brushes 22 disposed around an inside periphery of the hoop 16A. The brushes 22 extend from the inside periphery of the hoop 16A toward a center 24 of the hoop 16A. In FIG. 3, four brushes 22 are shown around the inside periphery of the hoop 16A. However, more or fewer brushes 22 may be used. The hoop 16A has a smaller inside diameter D than that of a regulation basket for basketball games. Accordingly, the hoop 16A may have a diameter D ranging from about 15.5 to about 17.5 inches. In some embodiments, the hoop 16A has a diameter D of 17 inches. Thus a ball 26 used to play the game according to the disclosure is smaller than a regulation basketball. The size of the ball for the game may range from about 9 inches to about 9.55 inches in diameter. The hoop 16A is attached to the backboard with a conventional basketball bracket 28.

Figure 2:
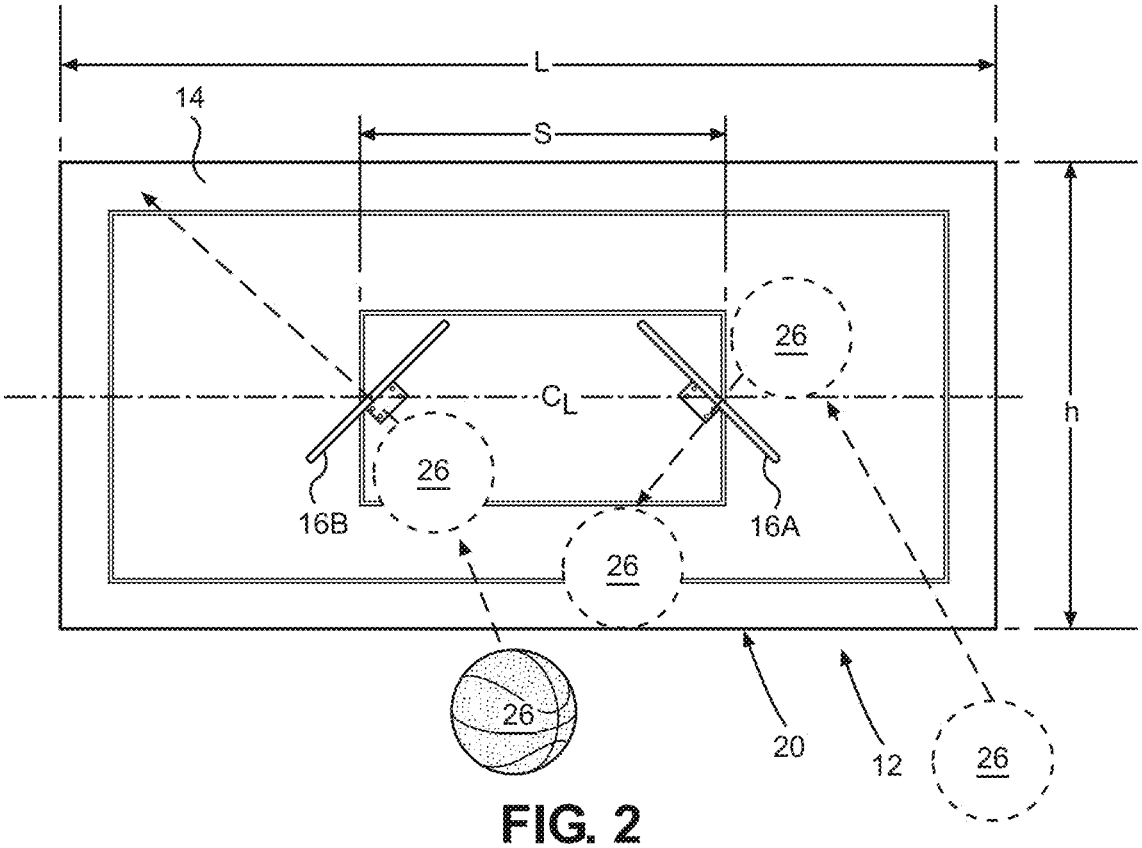
FIG. 2 is a plan view, not to scale, of goals on a backboard for playing the ball game of FIG. 1.

As shown in FIG. 2, the ball 26 may be shot at the goal 12 to cause the ball 26 to go from a bottom side of the hoop 16B to the top side of the hoop 16B to score a point. Additionally, the ball 26 may be shot at the goal 12 to cause the ball 26 to go from a top side of the hoop 16A to the bottom side of the hoop 16A to score a point.

As described above, the disclosed game may be played on a wide variety of playing surfaces including half of a basketball court. The goals 12 may be rolled into place onto the court or permanently affixed onto the court at 90 degrees to the basketball goals and midway between the centerline of the court and the basketball goal. Thus, two games can be played on a regulation basketball court. Likewise, the game may be played on a tennis court by placing the goals 12 midway between the end line and the net on half of the tennis court so that the game is played across half of the tennis court. The tennis net can remain in place on the tennis court or removed for the game.

At the beginning of the game, the score is 0 to 0. The first team to shoot the ball 26 through the hoop 16A or 16B gets 1 point. If the second team then shoots the ball 26 through the hoop 16A or 16B, the first team loses 1 point and the score is again 0 to 0. However, if the first team scores many points before the second team scores, such as 9 to 0, then the second team scores, the first team will lose a point and the score would be 8 to 0. Accordingly, the first or second team will always have 0 points. The team with points at the end of the game is the winner.

Because of the angle of the hoops 16A and 16B, there are no fouls shots in the disclosed game. After five fouls by a fouling team, the non-fouling team will get one point per foul. After 10 fouls by the fouling team, the non-fouling team will receive 2 points per foul. The foul points are added to or subtracted from the team having points. Accordingly, anyone checking the score will know by how much the winning team is ahead of the losing team.

As in basketball, the out of bounds rules for the disclosed game are the same.

Likewise, there are fouls, and technical fouls in the disclosed game as in basketball. The games are refereed, and there is a shot clock as in basketball. Other basket ball rules are followed, such as the rules for walking with the ball and tie balls.

Figure 5:
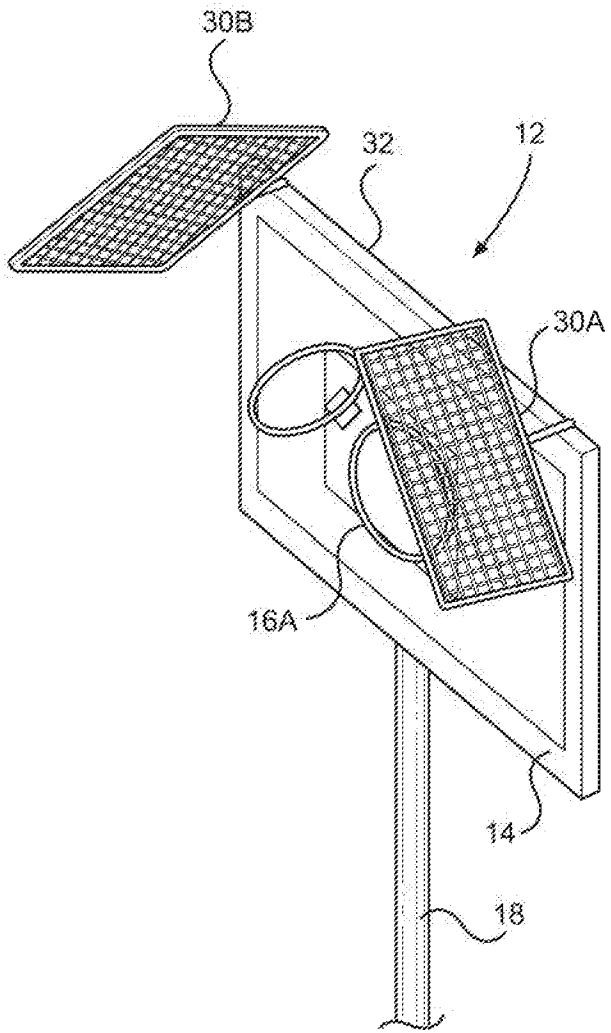
FIG. 5 is a perspective view, not to scale, of the embodiment of FIG. 4.
Figure 4:
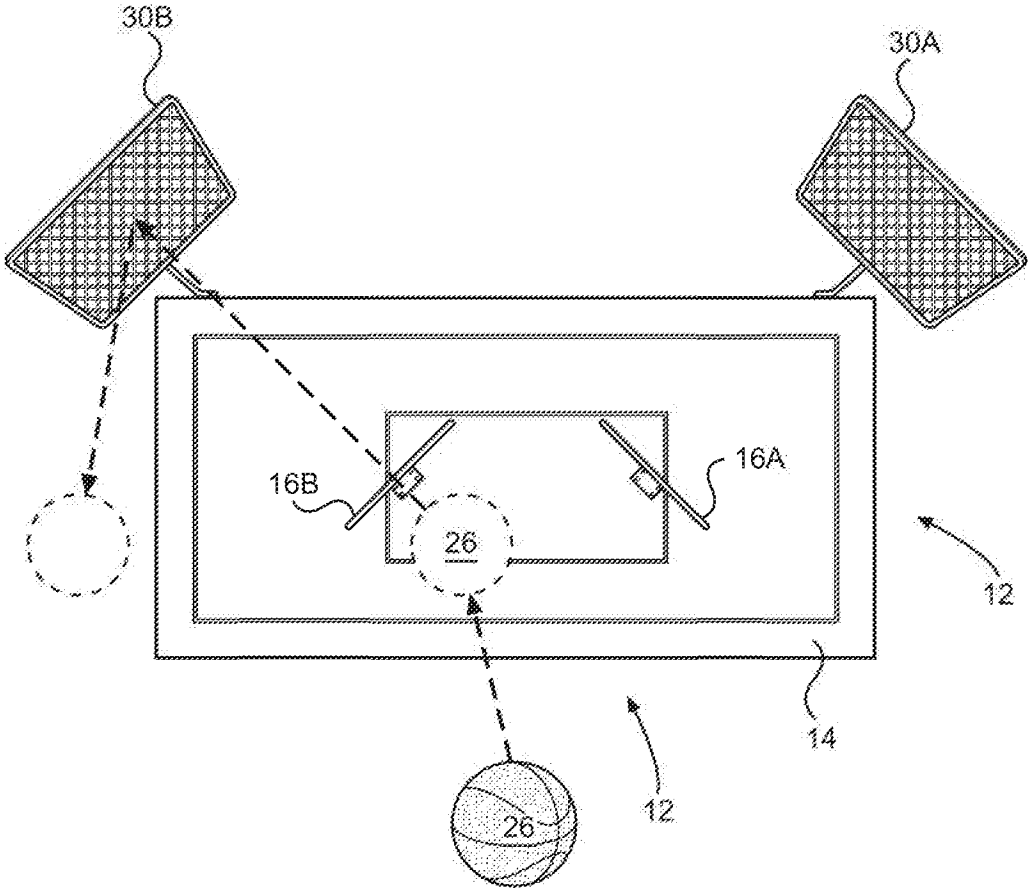
FIG. 4 is a plan view, not to scale, of a backboard, goals, and a net according to another embodiment of the disclosure.
Figure 6:
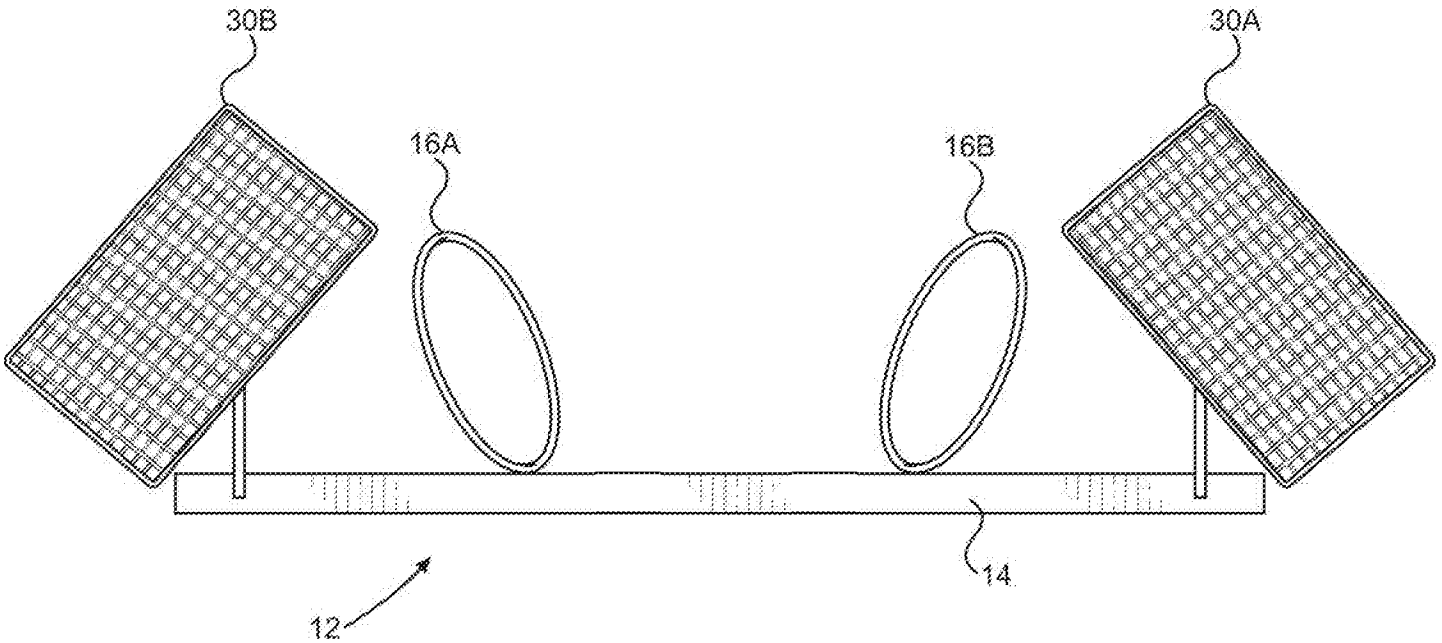
FIG. 6 is a top plan view, not to scale, of the backboard, goals and net of the embodiment of FIG. 4.

An alternative embodiment of the disclosure is illustrated in FIGS. 4-6. In the embodiment shown in FIGS. 4-6, nets 30A and 30B are disposed above the hoops 16A and 16B to prevent the ball 26, when shot upward through the hoops 16A and 16B from leaving the court 10 and hitting the crowd. The nets 30A and 30B can be attached to the backboard by any suitable means so that the nets 30A and 30B prevent the ball 26 from leaving the field of play when shot upward through the hoops 16A and 16B. Accordingly, the nets may be sized to cause the ball 26 to rebound into the field of play rather than over the backboard 14 and into the crowd. Multiple nets are shown, however a single net across the top 32 of the backboard may also be used to prevent the ball 26 from leaving the field of play.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A ball game comprising a spherical, air-filled ball, a first backboard mounted on a first support pole at a predetermined height above a first end of a playing court, the first backboard comprising a pair of first hoops mounted on the first backboard, the pair of first hoops being set apart a predetermined distance from one another, and each of the first hoops being fixed orthogonally by means of a basketball hoop bracket to the first backboard while being fixed at an oblique angle with respect to a horizontal plane defined by the playing court so that the pair of first hoops are angled in opposite directions, wherein the pair of first hoops have a diameter that is larger than the diameter of the spherical, air-filled ball, and wherein each of the first hoops consists essentially of a hoop and a plurality of brushes disposed around an inside circumference of the hoop.

2. The ball game of claim 1, further comprises a second backboard mounted on a second support pole at the predetermined height above a second end of the playing court, the second backboard comprising a pair of second hoops mounted on the second backboard, the pair of second hoops being set apart a predetermined distance from one another, and each of the second hoops being fixed orthogonally by means of a basketball hoop bracket to the second backboard while being fixed at an oblique angle with respect to a horizontal plane defined by the playing court so that the pair of second hoops are angled in opposite directions, wherein the pair of second hoops have a diameter that is larger than the diameter of the spherical, air-filled ball, and wherein each of the second hoops consists essentially of a hoop and a plurality of brushes disposed around an inside circumference of the hoop.

3. The ball game of claim 2, further comprising at least one net disposed above the pair of second hoops on the second backboard configured to prevent the ball from leaving the playing court when the ball is shot upward through the pair of second hoops.

4. The ball game of claim 2, wherein the pair of second hoops are attached to a middle portion of the second backboard with respect to a vertical dimension of the second backboard.

5. The ball game of claim 1, wherein the playing court is a rectangular playing court defined by out-of-bounds lines disposed around the perimeter of the playing court.

6. The ball game of claim 1, wherein the playing court is half of a basketball court or a tennis court.

7. The ball game of claim 1, further comprising at least one net disposed above the pair of first hoops on the first backboard configured to prevent the ball from leaving the playing court when the ball is shot upward through the pair of first hoops.

8. The ball game of claim 1, wherein the pair of first hoops are attached to a middle portion of the first backboard with respect to a vertical dimension of the first backboard.

9. The ball game of claim 1, wherein the playing court is devoid of a midcourt line.

10. A method of playing a ball game comprising:

providing a spherical, air-filled ball, at least one backboard mounted on a support pole at a predetermined height above a first end of a playing court, the at least one backboard comprising a pair of hoops mounted on the at least one backboard, the pair of hoops being set apart a predetermined distance from one another, and each of the hoops being fixed orthogonally by means of a basketball hoop bracket to the first backboard while being fixed at an oblique angle with respect to a horizontal plane defined by the playing court so that the pair of hoops are angled in opposite directions, wherein the pair of hoops have a diameter that is larger than the diameter of the spherical, air-filled ball, and where each of the hoops consists essentially of a hoop and a plurality of brushes disposed around an inside circumference of the hoops;

shooting the air-filled ball through the pair of hoops so that the ball travels through at least one of the pair of hoops from a top-side of one of the pair of hoops or from a bottom side of one of the pair of hoops; and scoring a point for a first team when the ball travels through at least one of the pair of hoops.

11. The method of claim 10, wherein a point is subtracted from the first team if a second team scores a point by causing the ball to travel through at least one of the pair of hoops.

12. The method of claim 10, wherein one point is scored for the first team when a second team commits five fouls on the first team.

13. The method of claim 10, wherein two points are scored for the first team when a second team commits ten fouls on the first team.

14. The method of claim 10, further comprising timing the game and awarding a winner of the game to a team with the most points at an end of a predetermined time.

15. The method of claim 10, wherein the ball game is devoid of foul shots.

* * * * *